United States Patent [19]

Stanley

[11] 3,983,608

[45] Oct. 5, 1976

[54] TEXTILE TREATMENT APPARATUS

[75] Inventor: Robert K. Stanley, Media, Pa.

[73] Assignee: Techniservice Division Textured Yarn Co., Inc., Kennett Square, Pa.

[22] Filed: Mar. 22, 1973

[21] Appl. No.: 343,645

Related U.S. Application Data

[63] Continuation-in-part of Ser. Nos. 124,213, March 15, 1971, Pat. No. 3,753,275, and Ser. No. 606,420, Dec. 30, 1966, and Ser. No. 846,457, July 31, 1969, Pat. No. 3,781,952, said Ser. No. 124,213, is a continuation-in-part of Ser. No. 822,429, May 7, 1969, Pat. No. 3,570,083, and Ser. No. 684,230, Nov. 20, 1967, Pat. No. 3,462,815, each is a continuation-in-part of Ser. No. 302,758, July 31, 1963, Pat. No. 3,376,622, which is a continuation of Ser. No. 216,524, Aug. 13, 1962, abandoned, said Ser. No. 606,420, is a continuation-in-part of Ser. No. 386,489, July 31, 1964, Pat. No. 3,317,977, which is a continuation-in-part of Ser. No. 216,447, Aug. 13, 1962, Pat. No. 3,145,947, said Ser. No. 846,457, is a continuation-in-part of said Ser. No. 822,429, said Ser. No. 386,489, and Ser. No. 717,882, April 1, 1968, Pat. No. 3,500,519, and Ser. No. 680,651, Nov. 6, 1967, Pat. No. 3,518,733, and Ser. No. 835,883, June 9, 1969, Pat. No. 3,559,254, and Ser. No. 815,425, April 11, 1969, Pat. No. 3,570,084, and Ser. No. 688,119, Dec. 5, 1967, Pat. No. 3,500,518, said Ser. No. 717,882, is a continuation-in-part of Ser. No. 600,698, Dec. 12, 1966, abandoned, said Ser. No. 835,883, is a continuation-in-part of Ser. No. 349,338, March 4, 1964, Pat. No. 3,348,283, said Ser. No. 688,119, is a continuation-in-part of Ser. No. 567,245, July 22, 1966, Pat. No. 3,386,142, which is a continuation-in-part of Ser. No. 401,160, Oct. 2, 1969, Pat. No. 3,279,025.

[52] U.S. Cl. ..... 28/1.3; 28/1.6

[51] Int. Cl.[2] ..... D02G 1/20

[58] Field of Search ..... 28/1.6, 1.3, 62, 72.1, 28/71.3, 72.14

[56] References Cited

UNITED STATES PATENTS

| | | | |
|---|---|---|---|
| 2,734,228 | 2/1956 | Hay | 28/1.6 |
| 3,654,677 | 4/1972 | Binford et al. | 28/1.3 |

*Primary Examiner*—Louis K. Rimrodt

*Attorney, Agent, or Firm*—Miller, Frailey & Prestia

[57] ABSTRACT

Textile yarns or strands are drawn and crimped under controlled conditions of tension, speed, and temperature, at both input and output stages, with resulting beneficial effects upon the resulting product, by specified apparatus.

7 Claims, 23 Drawing Figures

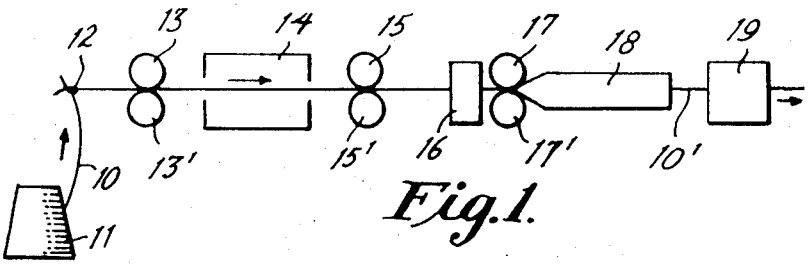
Fig. 1.
Fig. 5.
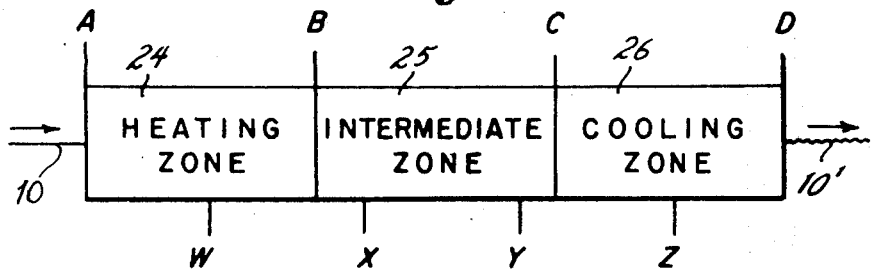
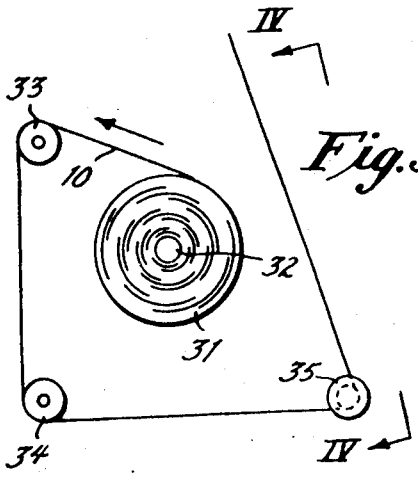
Fig. 3.
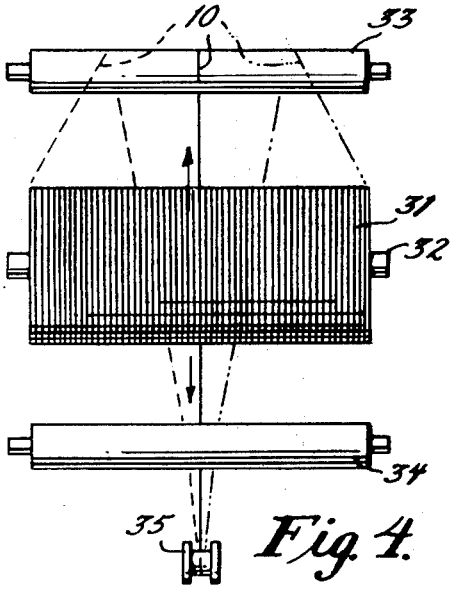
Fig. 4.
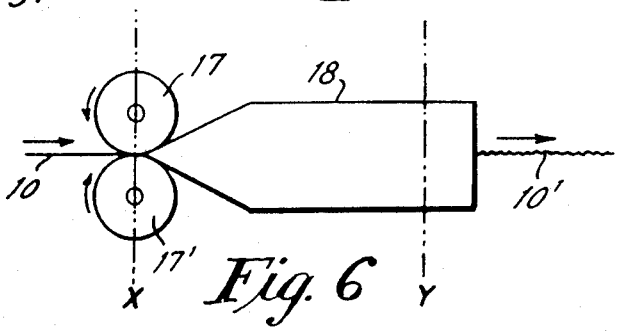
Fig. 6

Fig. 14.
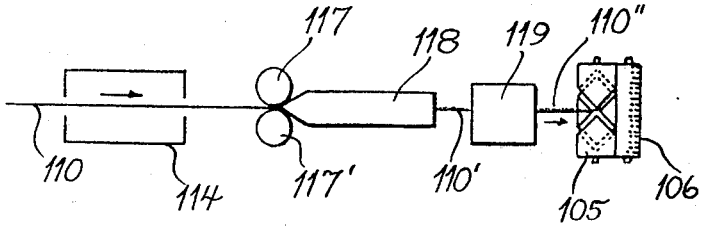
Fig. 16.
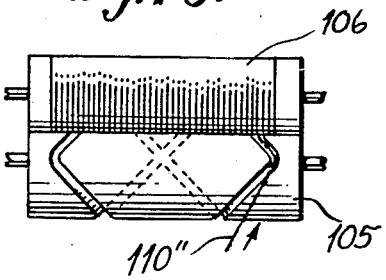
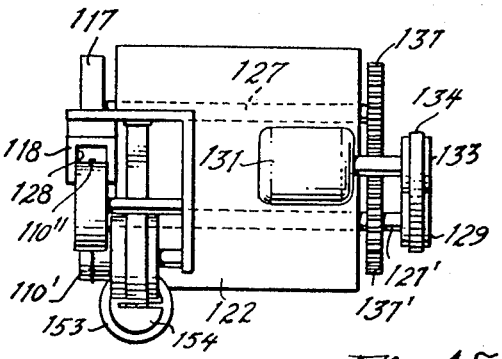
Fig. 15C.
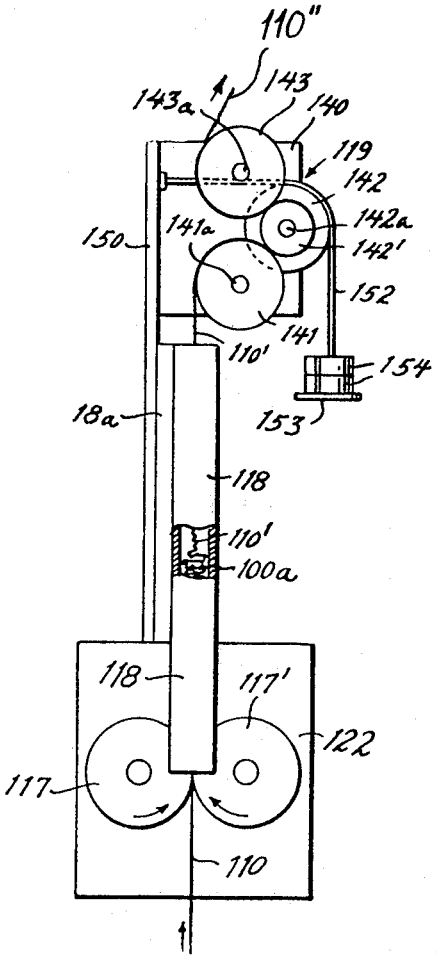
Fig. 15A.
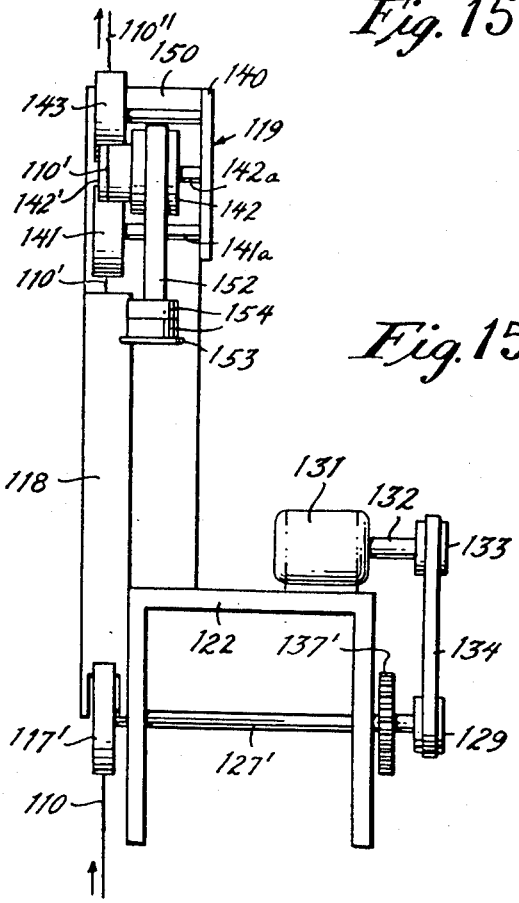
Fig. 15B.

TEXTILE TREATMENT APPARATUS

This application is a continuation-in-part of my following copending patent applications: (i) Ser. No. 124,213 filed 15 Mar. 1971, now U.S. Pat. No. 3,753,275, (ii) Ser. No. 606,420 filed 30 Dec. 1966, and (iii) Ser. No. 846,457 filed 31 July 1969, now U.S. Pat. No. 3,781,952, the benefits of which are claimed for this application, as are the benefits of the following applications and patents with which those applications (as identified parenthetically) have continuity, either directly or through intervening applications as follows:

i. a continuation-in-part of both Ser. No. 822,429 filed 7 May 1969 and now U.S. Pat. No. 3,570,083 and Ser. No. 684,230 filed 20 Nov. 1967 and now U.S. Pat. No. 3,462,815; both being continuations-in-part of Ser. No. 302,758 filed 31 July 1963 and now U.S. Pat. No. 3,376,622, which was in pertinent part a continuation of Ser. No. 216,524, filed 13 Aug. 1962 and subsequently abandoned.

ii. a continuation-in-part of Ser. No. 386,489 filed 31 July 1964 and now U.S. Pat. No. 3,317,977; being a continuation-in-part of Ser. No. 216,447 filed 13 Aug. 1962 and now U.S. Pat. No. 3,145,947.

iii. a continuation-in-part of the applications first mentioned in subparagraphs (i) and (ii) foregoing and the first mentioned in the following subparagraphs:

a. Ser. No. 717,882 filed 1 Apr. 1968 and now U.S. Pat No. 3,500,519, which was a continuation-in-part of Ser. No. 600,698 filed 12 Dec. 1966 and subsequently abandoned;

b. Ser. No. 680,651 filed 6 Nov. 1967 and now U.S. Pat. No. 3,518,733;

c. Ser. No. 835,883 filed 9 June 1969 and now U.S. Pat. No. 3,559,254, which was a continuation-in-part of Ser. No. 349,338 filed 4 Mar. 1964 and now U.S. Pat. No. 3,348,283; and d. Ser. No. 815,425 filed 11 Apr. 1969 and now U.S. Pat. No. 3,570,084 and Ser. No. 688,119 filed 5 Dec. 1967 and now U.S. Pat. No. 3,500,518; the latter being a continuation-in-part of Ser. No. 567,245 filed 22 July 1966 and now U.S. Pat. No. 3,386,142, being a continuation-in-part of Ser. No. 401,160 filed 2 Oct. 1964 and now U.S. Pat. No. 3,279,025.

The invention relates to treatment of textile yarns or strands by drawing and crimping the same under suitably controlled conditions, such as constant tension, speed, or temperature, or a combination thereof.

A primary object of the present invention is enhanced uniformity in compressive crimping of textile yarns or strands.

Another object is improvement in configuration or stability (or both) of crimp therein.

A further object is provision of a combined drawing and crimping process and apparatus therefor.

Other objects of this invention, together with means and methods for attaining the various objects, will be apparent from the following description and the accompanying diagrams.

FIG. 1 is a schematic representation of the processing of a textile yarn or strand according to this invention;

FIG. 3 is a side elevation of means for supplying a textile yarn or strand for such processing at constant tension from an illustrated alternative source package thereof;

FIG. 4 is a front elevation of the components of FIG. 3 taken at an inclination as indicated at IV—IV; and FIG. 5 is a schematic represenation, largely in block form, of such processing under controlled temperature conditions;

FIG. 6 is a schematic representation of a stuffer-crimper useful according to this invention, with especial reference to FIG. 5;

Figure 9:
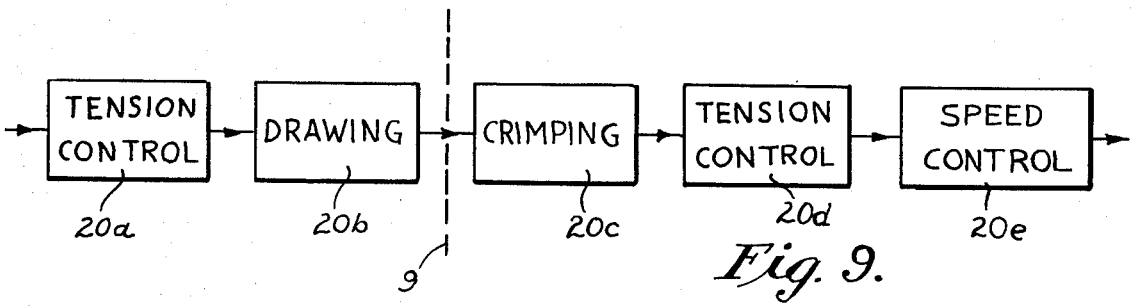
Figure 8A:
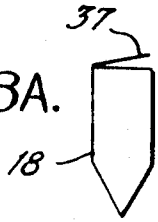
Figure 8B:
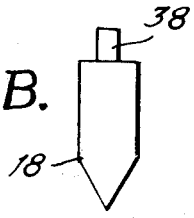
Figure 8C:
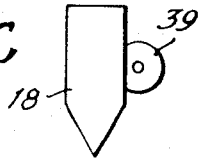
Figure 10:
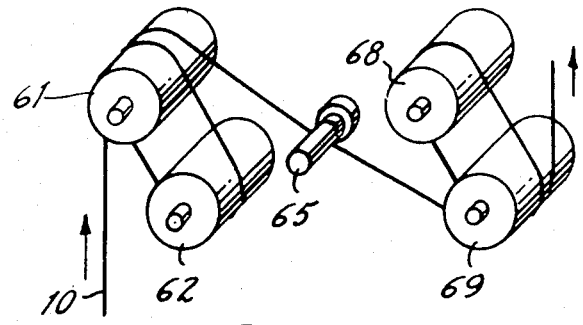
Figure 11:
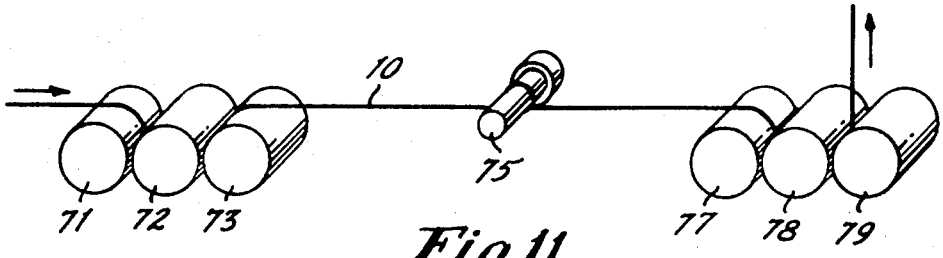
Figure 12:
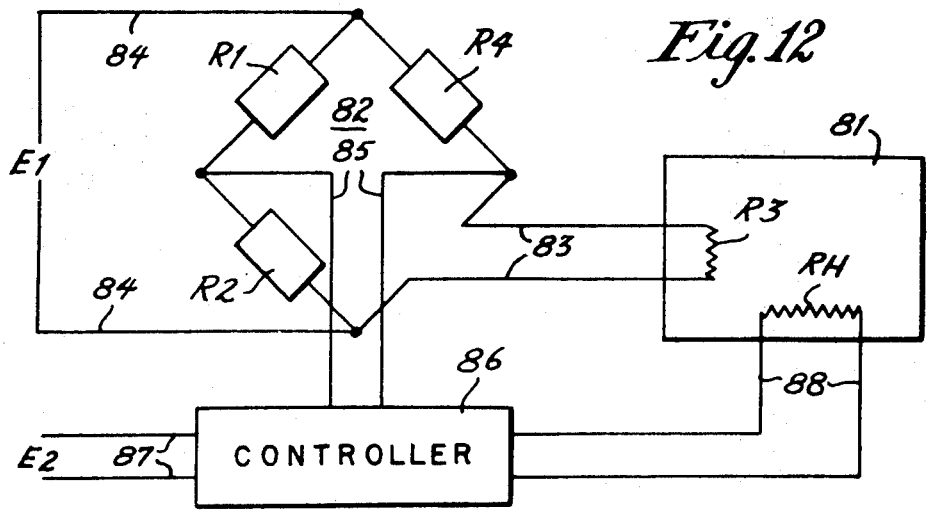
Figure 13:
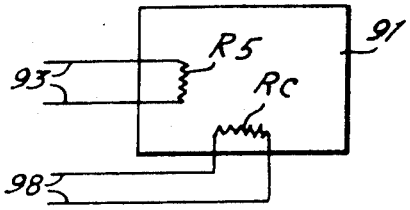

FIGS. 8A, 8B, and 8C are schematic representations of stuffer crimpers so useful and including movable impeding or back-pressure components;

FIG. 9 is a schematic illustration of the present invention, with especial reference to control of tension and speed in conjunction with strand drawing and crimping;

FIG. 10 is a perspective view somewhat stylized, of an arrangement of drawing components useful according to this invention;

FIG. 11 is a perspective view of an alternative arrangement of drawing components similarly useful;

FIG. 12 is a schematic representation of electrical circuitry and related components useful for control of temperature according to this invention;

FIG. 13 is a schematic representation of other electrical circuitry and related components useful therein;

FIG. 14 is a schematic representation of a succeeding stuffer-crimping step according to this invention;

FIG. 15A is a front elevation, partly cut away, of combined apparatus of preceding views, especially FIGS. 2A and 2B and FIGS. 7A, 7B, and 7C, with strand shown passing therethrough;

FIG. 15B is a side elevation of the apparatus and strand of FIG. 15A;

FIG. 15C is a plan of the apparatus of FIGS. 14A and 14B less the strand; and FIG. 16 is a front elevation of windup components indicated schematically in FIG. 14.

In general, the objects of the present invention are accomplished, in apparatus for treating textile strands, by successive strand-drawing means, strand-crimping means, and strand-tensioning means, together with means for controlling the speed of the tensioned crimped strand and preferably also means for controlling strand temperature within and between respective steps.

FIG. 1 shows, largely schematically, strand 10 unwinding over the end of conical package 11 and thereby acquiring a slight twist, to be withdrawn linearly or lengthwise and be so advanced or forwarded through guide 12 and successive pairs of rolls 13, 13' and 15, 15'. Enclosure 14, which may be heated, as by hot-air convection or by an electrical radiant-element (not shown) or which may simply constitute a barrier to loss of heat to the atmosphere from the yarn or strand, which is readily heated by the rolls, extends thereabout between the respective sets of rolls and may extend to or even about the rolls, if desired. Although not illustrated, methods and means for heating the rolls preferably internally, will come readily to the mind of a person skilled in the art: e.g., by circulation of heated fluid therein or by electrical means as disclosed in my U.S. Pat. No. 3,111,740, especially FIGS. 6 to 8 and the description thereof.

Traversing means 16, optionally used (FIG. 1) for assisting in distribution of the yarn or strand along the nip of feed rolls 17, 17', follows the second pair of rolls and precedes the feed rolls at the entrance to stuffing chamber 18. The yarn or strand proceeds directly thereto from rolls 15, 15', which preferably define a stage of drawing the strand to increased length. Compressively crimped yarn or strand 10' (so designated to distinguish it from the uncrimped starting form) is withdrawn from the exit of the chamber past aftertreating means 19, in which the freshly crimped yarn or strand is adjusted in tension or temperature (or both), tension control necessitating speed control, of course, before being subjected to further processing or being wound into package form.

Figure 2A:
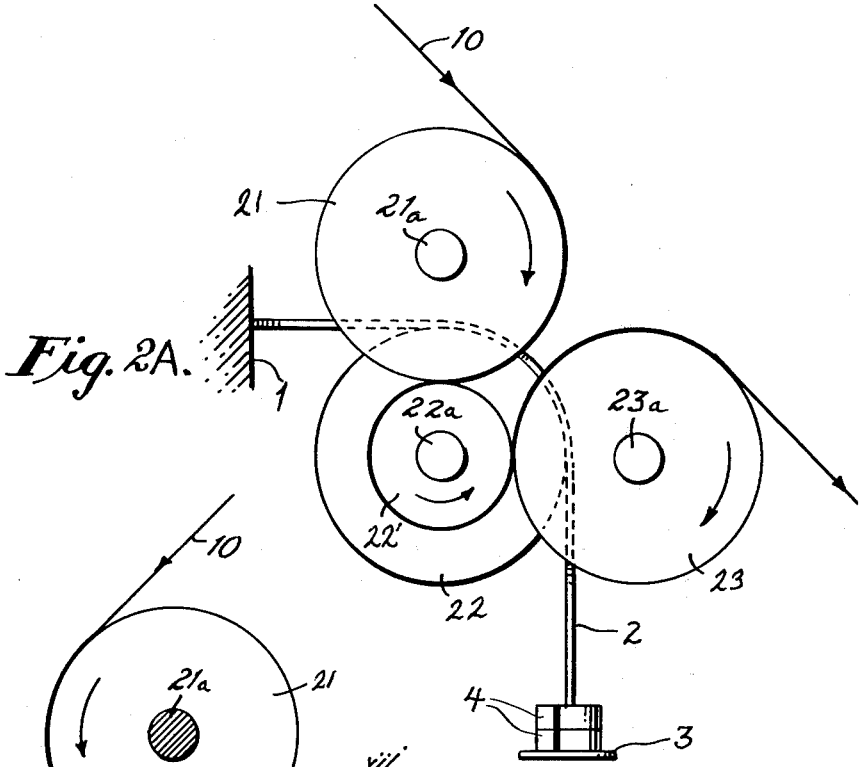
FIG. 2A is a front elevation of adjustable constant-tensioning apparatus useful in practicing the invention.
Figure 2B:
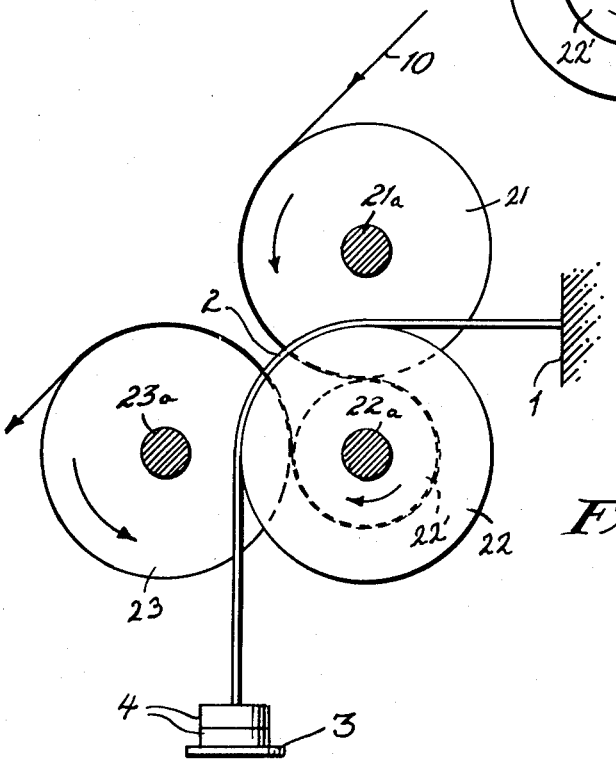
FIG. 2B is a rear elevation of the apparatus of FIG. 2A.

FIGS. 2A and 2B show in elevation, from the front and rear, respectively, specific apparatus (useful as in 19 of FIG. 1 or previously as in 20*a* of subsequent FIG. 9) for accomplishing strand tension control according to this invention. First roll 21 on axle 21*a* and third roll 23 on axle 23*a* are both contiguous with minor cylindrical portion 22' of second roll 22, which is mounted on axle 22*a* parallel to the other two axles. The first and third rolls do not touch one another. Strand 10 passes about slightly less than half of each of the first and third rolls and about three-fourths of the minor portion of the second or intermediate roll, passing between the nip formed by each of the first and third rolls with the latter. Belt or strap 2 extends about a quadrant of the major portion of roll 22 from fixed location 1 at one end to spot 3 at the other end, upon which are supported weights 4, thereby biasing the belt or strap into frictional contact with the roll surface.

Strand 10 is pulled at constant speed, as by suitable forwarding, withdrawal, or windup means or other processing means (which may include draw rolls, etc.) in essentially non-slipping contact with first roll 21, minor portion 22' of the second roll, and third roll 23, thereby rotating them in the directions indicated by the arrows. The major portion of roll 22 rotates in slipping frictional contact with belt or strap 2, which counters the positive rotation and thereby tensions the strand evenly. The constant tension can be increased by adding weights, and reduced by subtracting weights, carried by the belt or strap. The relative sizes of the major, strand-supporting portion of roll 22 and minor belt-supporting portion 22' thereof may be changed for a like or other purpose, as by press-fitting collars of various sizes thereon.

It will be understood that conical package 11 may be replaced by any suitable source of yarn or strand 10, such as traverse-wound package 31 shown in side and front (slightly inclined) elevation, respectively, in FIGS. 3 and 4. This package is mounted for rotation on axle 32 suitably supported. Mounted on axes parallel thereto are roll 33 located above and behind the package, roll 34 located below and behind the package, and roller guide 35 located ahead of and below the package and centered from end to end thereof. As yarn or strand 10 unreels (without acquiring any twist) from package 31 and about rolls 33 and 34 and roller guide 35, it traverses the successive rolls to a successively decreasing extent as compared with the full traverse thereof on the package, as indicated by the broken lines. This arrangement smoothes out the tension changes characteristic of a yarn or strand supplied from a traverse-wound package, thereby facilitating uniformity of further treatment and consequent elimination of objectionable irregularities in the resulting product.

Regardless of type of supply package or tension control, the resulting tension in the strand is essentially constant at a maximum value determined by one or the other type of frictional contact just described, or equivalent tensioning method, which tends to smoothe out pre-existing tension. Constant-tension tensioning means of the former or other kind is employed also immediately after the crimping step, as indicated below.

FIG. 5 shows schematically the location of heating, intermediate, and cooling zones, represented in block form. After leaving its source of supply, yarn or strand 10 passes successively through Heating Zone 24, which has initial and final boundaries A and B; Intermediate Zone 25, which has initial and final boundaries B and C; and Cooling Zone 26, which has initial and final boundaries C and D; after which it is withdrawn for further processing or windup as previously mentioned. Location W in the heating zone, locations X and Y in the intermediate zone, and location Z in the cooling zone are characterized further below.

FIG. 6 schematically locates feed rolls 17, 17' and stuffing chamber 18 with respect to the zones indicated in FIG. 5. Location X in the intermediate zone is denoted as coincident with the roll axes, and location Y (also in the intermediate zone) as at or near the end of the chamber, or wherever the yarn or strand is released from the impeding force or back-pressure that applies crimping stress thereto.

Figure 7A:
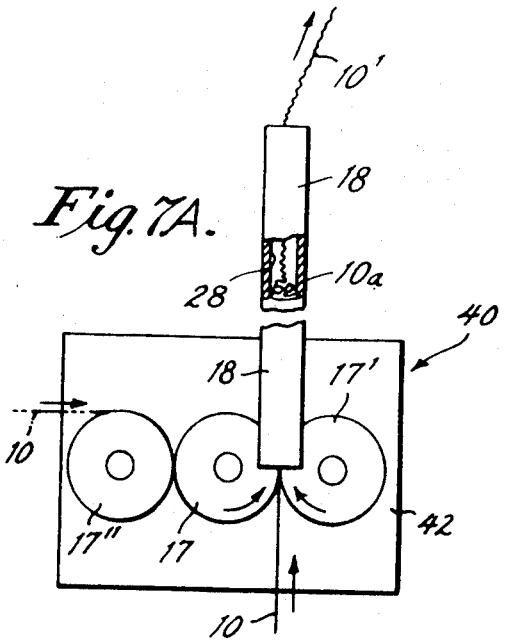
FIG. 7A is a front elevation, partly cut away, of such a stuffer crimper in further detail and showing a yarn or strand passing therethrough.
Figure 7B:
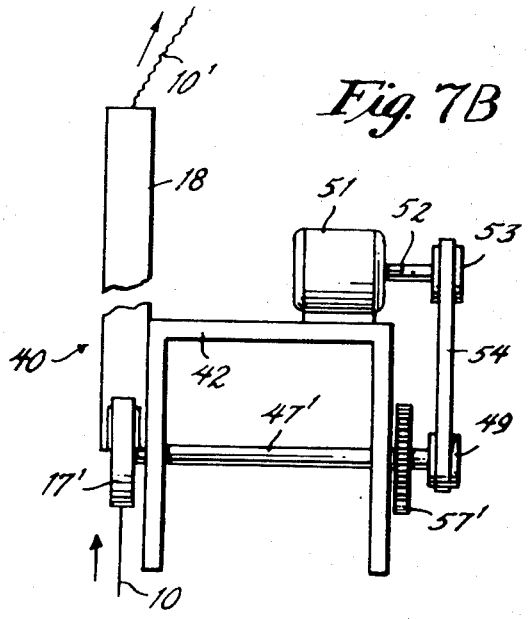
FIG. 7 is a side elevation of the stuffer crimper shown in FIG. 7A.
FIG. 7C is a plan view of the stuffer crimper of the preceding views, less the yarn or strand.
Figure 7C:
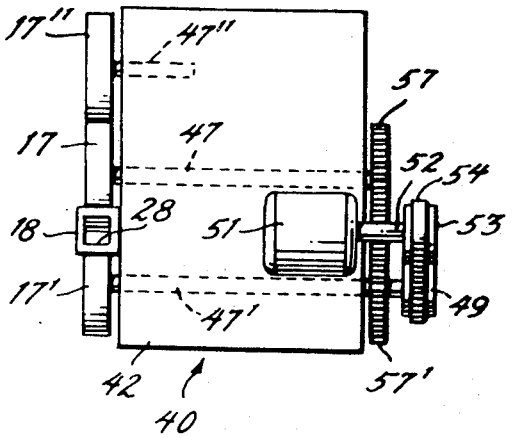

FIGS. 7A, 7B, and 7C show in front elevation, side elevation, and top plan, respectively, stuffer crimper 40 embodying feed rolls 17, 17' and stuffing chamber 18, as well as related components. No strand-impeding element is included in the apparatus of this view, it being understood that one may be used therewith, if desired, as shown below. Here lateral confinement by and friction with the sidewalls of the stuffing chamber suffices, as disclosed in my aforementioned U.S. Pat. Nos. 3,279,025 and 3,386,142. As shown in FIG. 7A, part of the front wall of stuffing chamber 18 is cut away to reveal crimped strand 10' inside chamber bore 28 being withdrawn from the leading or head end of accumulation 10*a* thereof in the form of a compacted or compressed wad or plug in the lower part of the chamber and which otherwise would extend in the chamber to at least any impeding element used therewith.

Also shown in FIGS. 7A to 7C is frame 42, which supports stuffing chamber 18 and related components and which has an inverted U-shape as viewed from the side (FIG. 8). Shafts 47, 47' for respective feed rolls 17, 17' are journaled in the front and rear walls of the frame and have intermeshing gears 57, 57' thereon behind the rear wall of the frame. Shaft 47' also has driven pulley 49 affixed thereon. Motor 51 on the horizontal upper surface of the frame has shaft 52 on which is drive pulley 53. Belt 54 interconnects pulleys 53 and 49 to transmit rotational force from the motor to the gears, shafts, and the feed rolls themselves. Also shown is roll 17'' carried on stub shaft 47'' parallel to and aligned with the feed rolls and their shafts, with the peripheral surface of roll 17'' contiguous with the peripheral surface of feed roll 17 on one side thereof as is the peripheral surface of feed roll 17' on the opposite side. The tapered entrance of the stuffing chamber, shown schematically in earlier views, extends within the bight of the feed rolls but is hidden from view by the lower end of the chamber, the front and rear walls of which overlap portions of the front and rear faces of the rolls as far as the roll nip so as to ensure that the infed yarn or strand enters the chamber rather than possibly escaping therefrom.

According to this invention, thus far considered, yarn or strand 10 is withdrawn from a suitable source of supply, preferably under constant tension, then is heated by or between successive sets of rolls without sliding contact with a heated solid surface and is stuffed while hot into a confining chamber, within which it is subjected to longitudinal compression to buckle it into crimped configuration and from which it is then withdrawn and usually wound up. The entering yarn or strand usually is fed or driven into the roll nip and the juxtaposed chamber entrance from along the common internal tangent thereto extended therefrom, as shown in solid in FIG. 7A. Where it is desired to grip the yarn or strand over a greater distance than is provided by the nip of feed rolls 17, 17′ it may proceed along the alternative path, shown there in broken lines beginning at the left of the view and extending about a quadrant or so of added roll 17″, downward through the nip of rolls 17″ and 17, about the lower half of roll 17, and then upward to the nip of rolls 17, 17′ and the chamber entrance.

The heated yarn or strand enters the stuffing chamber at desired crimping temperature, which is dependent upon the composition, denier, processing rate, time in the chamber, etc., and often is within the range of 150° to 250° F. So long as it is under substantial crimping compression it preferably is kept under adiabatic conditions, or with addition (or subtraction) of heat such as may be required to compensate for heat loss (or frictional heating) and thereby to maintain essentially constant-temperature conditions until completion of crimping. Then heat is removed from the crimped yarn or strand in the cooling zone to bring it to approximately room temperature, as by ventilation with cool air or otherwise, it being recognized that the crimped yarn or strand probably will have cooled somewhat (e.g., to about 120° F.) before reaching the stuffing chamber exit. Such cooling prevents undesired deformation that might occur in hot yarn or strand wound into package form.

FIGS. 8A, 8B, and 8C show, also schematically, three conventional types of stuffing (or stuffer box) chambers 18, with particular reference to impeding or back-pressure elements for the yarn or strand therein, in the order of their development: gravity-actuated or spring-loaded gate 37 in FIG. 8A; reciprocating plunger 38, without or with a central longitudinal bore, in FIG. 8B; and unidirectionally movable or moving wheel (which also comprehends belts, etc.) or gear-like element 39 in FIG. 8C. Each of these types of impeding means applies back-pressure to crimped yarn or strand 10′ seeking to escape from the chamber, or from that part thereof in which it is under crimping stress, as the feed rolls (shown previously) or equivalent means forcibly stuff more uncrimped yarn or strand 10 into the chamber. Examples of these respective types may be found in U.S. Pat. Nos. 2,686,339, 2,734,229, and 3,027,619; hence, the omission of most details of their construction. The rate of windup or other withdrawal of crimped yarn or strand 10′ may be synchronized in timed relation to the rate of feed of uncrimped yarn or strand 10 into the stuffing chamber as disclosed in my U.S. Pat. Nos. 3,280,444 and 3,388,440, especially FIGS. 4 to 9 thereof and the related description, if desired.

FIG. 9 shows schematically five steps or zones, numbered **20*a* through 20*e* and shown in block form, of strand treatment in consecutive or successive steps. The first and fourth of the numbered steps or zones (20*a* and 20*d*) are labeled Tension Control, while the intermediate two (i.e., 20*b* and 20*c*) are labeled Drawing and Crimping, respectively, and the final one (i.e., 20*e*) is labeled Speed Control. Broken line 9 extending vertically between the symbols for the 20*b* and 20*c*** indicates that the output from the drawing step or zone need not be to a crimping step or zone, and that the input to the latter step or zone need not be from a drawing step or zone, although such a combination may be employed, and that the intervening time may vary although it is preferably minimal. Tension Control also may be employed at such location(s), i.e., after drawing and before crimping. Speed Control is readily provided by constant-speed forwarding to windup or further processing, which may include a succeeding crimping or other compacting step.

As described with reference to an open-ended stuffing chamber, the strand is withdrawn from the accumulation in the chamber at a constant rate and tension sufficient to keep the furthest extent of the strand accumulation at some distance from the end of the chamber, usually within the range of from about two-thirds to about nine-tenths of the infeed rate. Suitable tensions for nylon strands of about 2000 total denier and 140 filaments, for example, are on the order of tenths of a gram per denier, depending upon the desired degree of crimp, half a gram per denier often being a satisfactory value. No means or method for synchronizing windup and feed rates is required, as the crimped strand will accumulate to a substantially constant level in the chamber, rising only slightly thereabove and falling only slightly therebelow, that level being determinable by setting the overall tension and, of course, by the physical characteristics of the strand, as well as the temperature, wall friction, etc.

Preadjustment of the superimposed tension effects control of the degree or extent of crimp in the strand, the tension and the crimp varying in the same sense with respect to one another. Thus, a high tension produces an increased degree of crimp, together with a high level of strand in the chamber, as compared with a low level of strand and decreased crimp at a lower tension. Degree of crimp may be determined by any conventional method, and high crimp may be apparent in part as increased crimp frequency, reduced crimp leg length, reduced angle between adjacent legs, increased crimp retention under tension, or any combination of these with one another, or possibly other crimp characteristics.

FIGS. 10 and 11 show in perspective two suitable arrangements for drawing yarns or strands to increased length directly before crimping, each such arrangement consisting of two sets of rolls variously arranged but flanking a draw pin such as is optionally useful in localizing the draw. It will be understood that at least one of the rolls in each of these two sets is driven by suitable motive means (not shown) and that all the rolls within each set rotate at constant speed, whether driven directly by the motive means or indirectly by contact (essentially non-slipping) with one another. The surface speed of the rolls in the second or forwarding set is sufficiently greater than the speed of the rolls in the first or input set to draw the yarn or strand to desired increased length therebetween. The draw pin does not rotate but is fixed so as to snub the strand passing about it. The pin may, but need not, be heated by any conventional means (e.g., electrically or by steam, preferably supplied internally) in accordance with the art of textile drawing.

In FIG. 10, pair of input rolls 61, 62 spaced from one another in godet fashion precede draw pin 65, and similar pair of output or forwarding rolls 68, 69 follow the draw pin. Yarn or strand 10 passes successively about the input pair of rolls as a group, about the draw pin, and about the output pair of rolls as a group. Additional wraps about the respective pairs of rolls may be employed if required for essentially non-slipping contact therewith. See my U.S. Pat. No. 3,518,733 for a similar arrangement in which the spacer or separator rolls are smaller than the godet rolls.

In FIG. 11, input rolls 71, 72, 73 are arranged in a horizontal three-roll stack, and output rolls 77, 78, 79 are similarly arranged. Thus, rolls 71 and 73 flank and are contiguous with roll 72, while rolls 77 and 79 are similarly arranged with respect to roll 78. Yarn or strand passes about an upper quadrant of roll 71, through the nip between rolls 71 and 72, about the lower half of roll 72, through the nip between rolls 72 and 73, and over an upper quadrant of roll 73 in its path to draw pin 75. From the draw pin it proceeds in like manner about a quadrant of roll 77, through the nip between rolls 77 and 78, halfway about roll 78, through the nip between rolls 78 and 79 and onward to a stuffer crimper, previously shown. Because the yarn or strand is gripped by successive roll nips as well as by frictional contact with portions of the roll surfaces, complete or multiple wraps are not required to ensure essentially non-slipping roll contact.

It will be understood that either arrangement of draw rolls may be substituted for pairs of rolls 13, 13' and 15, 15' shown in FIG. 1. Heating enclosure 14 may be retained or not, as desired, but in either event it is most convenient and effective to heat one or both sets of rolls, possibly in addition to (or instead of) heating the draw pin. Heating the first set of rolls preheats the strand for drawing, rendering it generally easier to draw, and incidentally preheating it for crimping, while heating the second set of rolls in addition thereto, if desired, at least sufficiently to prevent the drawn strand from cooling in the interim (however brief) before crimping, is conducive to a steady and high degree of crimping. Of course, as can be seen readily from the prior discussion hereinabove, even heating only the second set of rolls is often beneficial to the degree of crimp. Although not illustrated or further described herein, suitable methods and means for heating the draw rolls, preferably internally, will be apparent, such as by use of heated fluid or electrical resistance elements as mentioned above in the discussion of heating one or more of rolls 13, 13' and 15, 15'.

The relative speeds of the output and input rolls determine the draw ratio, which essentially determines the relationship of the new length of the drawn strand to its former or undrawn length. Customary draw ratios are in the range from about 2 to 6X, although sometimes higher draw ratios may be employed and lower draw ratios may be employed in individual steps of multiple-stage drawing processes. A common draw ratio for 66 nylon is 4X, corresponding to an output/input speed ratio of 4 to 1. Practicable processing speeds are undergoing continual increase and often are in the vicinity of a thousand yards or meters per minute into the crimping apparatus, but somewhat slower or faster speeds may be employed. The speed at which the strand is fed into the crimper often coincides with the output speed from the drawing zone, and in that event one or more of the crimper feed rolls may be combined with (or replaced by) one or more of the output draw rolls. For example, output draw rolls 71, 72, 73 of the draw system of FIG. 11 may coincide with rolls 17'', 17, 17' of the stuffer crimper of FIGS. 7A to 7C, using the alternative path (broken lines) for the yarn or strand to be crimped. Such an arrangement further maintains the desired elevated temperature thereof and continuity of treatment without appreciable intervening delay or time lag. Regardless of the relative arrangement of parts, the crimping means is positioned in relationship to the drawing means for the receipt of freshly drawn yarn or strand therefrom with a minimum of delay.

FIG. 12 shows schematically suitable electrical circuitry and related components useful in assuring the desired heating and control thereof. Heating region 81, shown in block form, may constitute (or be part of) Heating Zone 24. Electrical potential E1 provides, via pair of leads 84, the input to electrical bridge 8, which may be a simple Wheatstone bridge (or a more complex type) provided with resistors (or other suitable impedance elements) R1, R2, R3, and R4 in its various arms: resistor R3 being a thermistor having pair of leads 83 and being located in region 81 to sense the temperature thereof, and the other resistors being inappreciably susceptible to resistance change with variation in temperature (or being maintained at constant temperature). The bridge output is transmitted via pair of leads 85 to Controller 86, which is supplied with electrical potential E2 via pair of leads 87 and which controls the temperature of region 81, in response to the bridge output, by means of heating element RH located in that region and connected to the controller via leads 88.

Instead of being a resistor the heating element may be suitable radiant (or other) heating means and the leads thereto be suitable piping, the controller controlling the flow of heating fluid through the piping in conventional manner as it can control the flow of heating electrical current. Further details of the controller and its connection into the circuit are omitted for simplicity, being obvious to persons having an understanding of the pertinent art.

FIG. 13 shows, also schematically, cooling region 91, which may constitute (or be part of) Cooling Zone 26. It is provided with temperature-sensitive resistor or thermistor R5 located therein and having pair of leads 93 to a bridge (not shown) by analogy to the similar elements of the immediately preceding view. Cooling element RC also located in region 91 has pair of leads 98 to a controller (not shown), the further analogy with the apparatus of FIG. 12 being apparent. The cooling element may be either a thermoelectric element or a refrigerating coil (in which instance leads 98 would be piping), for example. As suggested above, a cooling element might be useful in Intermediate Zone 25 as well, such as near (inside) the entrance to the stuffing chamber where the applied logitudinal compression and resulting buckling or columnar collapse of the yarn or strand generates undesired heat, as may friction with the feed rolls or the chamber entrance itself.

With suitable insulation of the Heating, Intermediate, and Cooling Zones, such apparatus permits accurate control of the temperature thereof. The respective zones should be sufficiently large, as compared with the rate of travel of the strand therethrough, to hold the strand for a long enough time to have the desired effect upon it. Temperature-sensing means may be provided at locations W, X, Y, Z, as suggested above, or at other convenient locations to ensure accurate determination of temperature, together with temperature-controlling means as may be required for the desired temperature control. Insulation of the Intermediate Zone, which contains the crimping means, from the other two zones may suffice to ensure adiabatic conditions therein. However, if that does not suffice to maintain the strand at essentially constant temperature therein, and especially while it is under crimping stress, one or more controllers (with heating or cooling elements, or both) may be employed as in the other two zones.

While operation at essentially adiabatic, or at least constant-temperature, conditions throughout is preferred, it will be apparent that this invention readily permits either a high-temperature crimping step followed by an otherwise similar low-temperature crimping step, or vice versa, either of which may be desired for whatever reasons.

Output strand 10'' from the prior crimping apparatus proceeds at constant tension and speed to, and thereby becomes input strand 110 for, the subsequent stuffer-crimping apparatus shown schematically in FIG. 14 and in more detail in FIGS. 15A to 15C. Heater 114 for the strand in advance of the entrance to this second crimping apparatus is optional and may be useful for maintaining isothermal conditions rather than permitting the strand to cool between crimping steps to a temperature less than the temperature prevailing during the crimping. In this respect the entire region from the entrance to the previous crimper to the outlet from this crimper may be designed to meet the requirements for the Intermediate Zone. Heater 114 preferably is of radiant electric, hot-air convective, or other dry type, to avoid introducing or to help dispel undesired moisture as too close to windup of the product, whereas previous heater 14 or an earlier preheater may utilize steam injection, as mentioned above.

Because of the crimp already imparted to the strand there is less reason for using means to traverse the strand with respect to feed rolls 117, 117' at the entrance to stuffing chamber 118, although some such traversing means may be employed if desired. In other respects the apparatus and procedure are relatively unchanged, but after passing through tensioning means 119 resulting strand 110'' is shown as being wound at constant speed onto cylindrical package 106 by grooved traversing drive roll 105. Alternatively the strand could be passed through another crimping or other compacing zone of the same or a different sort, if desired.

The two successive crimping steps with illustrated tension and speed control, especially therebetween, provide a well stabilized crimped textile strand having a lower potential shrinkage when subjected to further processing in conventional manner, thereby rectifying a feature (i.e., relatively high shrinkage potential) of once crimped textile strands sometimes criticized. The resulting strands also are characterized by desirable distribution of crimp about the longitudinal strand axis, whereas a single stuffercrimping often produces a more planar crimp distribution.

In FIG. 14, last described above, and in succeeding views, reference numerals for items similar or corresponding to items treated in the foregoing description of previous views are higher by a given round number (e.g., 80, 100, or 150); with such indication in relationship, specific mention of many thereof is superfluous and is omitted below.

Thus, FIGS. 15A, 15B, and 15C illustrate stuffer crimper 140 corresponding generally to that shown in FIGS. 7A, 7B and 7C. Moreover, stuffing chamber 118 as shown in these later views carries constant-tension tensioning means 119, made up of components like those shown in FIGS. 2A and 2B, through which strand 110'' passes upon exiting from the chamber.

FIG. 16 shows grooved strand-traversing drive roll 105 for traverse-wound package 106 onto which strand 110'' is shown in FIG. 14 as being wound. Alternatively, the strand could be forwarded for further processing before being wound up or instead thereof as by being fabricated into a textile article.

Although the diagrams illustrate only what appears to be a monofilament, it will be understood that yarns or strands suited for treatment according to this invention include also multifilaments and composite structures comprising shorter lengths (e.g., staple) than are usually considered to be continuous filaments. Although many, if not all, of the suitable compositions are drawable to increased length, usually resulting in orientation of their component macromolecules longitudinally, detailed consideration of drawability of the yarns or strands being treated has been deferred to here in this application in the interest of orderliness and simplicity of description and illustration.

Prominent among suitable textile compositions are the nylons (polycarbonamides), e.g., 66 nylon (i.e., polyhexamethylene adipamide), also 6-nylon, 11 nylon, 610 nylon, and fiber-forming copolymers thereof, including terpolymers. Other suitable polymeric materials for yarns or strands to be treated according to this invention include most of the thermoplastic fiber-forming materials, such as polyhydrocarbons (e.g., polyethylene, polypropylene), polyesters (e.g., polyethylene terephthalate), polyacrylonitrile and copolymers of acrylonitrile with other vinyl compounds, also copolymers of vinyl chloride and vinylidene chloride, and polyurethanes. This list is simply exemplary and is not intended to be exhaustive of suitable compositions, most or all of which are thermoplastic.

The stuffing chamber and other apparatus elements may be made of steel or other durable material. If desired, the inside wall of the chamber may be coated (e.g., with tetrafluoroethylene) to reduce the coefficient of friction, in which event the chamber should be lengthened accordingly. A chamber length of about a yard or meter (inner width about ¼ inch or a centimeter for use with strands of about 10 to 100 denier) has proved suitable for nylon and other commonly available textile strand materials, in an uncoated chamber.

While various embodiments of this invention have been disclosed, other modifications may be made, as by adding, combining, or subdividing parts or steps, while retaining significant benefits and advantages of the invention, some of which have been mentioned and others of which will become apparent to those undertaking to practice the invention in accordance with the foregoiong teaching. The invention itself is defined as follows.

I claim:

1. An apparatus for treating yarn comprising yarn drawing means, yarn stuffer box crimping means, yarn constant-tension tensioning means, yarn speed-control means and yarn packaging means, said means being consecutively operatively connected, said yarn drawing means comprising a feed roll and a draw roll to draw yarn, and stuffer box crimping means being positioned in relationship to said drawing means for the receipt with a minimum delay of freshly drawn yarn, said yarn constant-tension tensioning means being positioned for the receipt of freshly crimped yarn from said stuffer box crimping means and for the application of a constant tension to said yarn and said yarn speed-control means being positioned for the receipt of the tensioned yarn for yarn packaging.

2. An apparatus for treating yarn comprising yarn drawing means, yarn crimping means, yarn constant-tension tensioning means and yarn speed control means, said means being consecutively operatively connected, said yarn drawing means comprising a feed roll and a draw roll to draw yarn, said crimping means being positioned in relationship to said drawing means for the receipt with a minimum delay of freshly drawn yarn, said yarn constant-tension tensioning means being positioned for the receipt of freshly crimped yarn from said crimping means for and the application of a constant tension to said yarn, and said yarn speed control means being positioned for the receipt of the tensioned yarn therefrom.

3. The apparatus of claim 2 wherein the yarn speed control means comprises a forwarding roll, and including packaging means operatively connected for receipt of yarn therefrom.

4. An apparatus for treating yarn comprising yarn drawing means, yarn crimping means, yarn constant-tension tensioning means and yarn constant-speed windup means, said means being consecutively operatively connected, said yarn drawing means comprising a feed roll and a draw roll to draw yarn, said crimping means being positioned in relationship to said drawing means for the receipt with a minimum delay of freshly drawn yarn, said yarn constant-tension tensioning means being positioned for the receipt of freshly crimped yarn from said crimping means and for the application of a constant tension to said yarn and said yarn constant-speed windup means being positioned for the receipt of the tensioned yarn.

5. The apparatus of claim 4 wherein the crimping means is a stuffer box crimper.

6. An apparatus for treating yarn comprising yarn drawing means, yarn crimping means, yarn constant-tension tensioning means and yarn speed-control means, said means being consecutively operatively connected, said yarn drawing means comprising a feed roll and a draw roll to draw yarn, said crimping means being positioned in relationship to said drawing means for the receipt with a minimum delay of freshly drawn yarn, said yarn constant-tension tensioning means being positioned for the receipt of freshly crimped yarn from said crimping means and for the application of a constant tension to said yarn and said yarn speed-control means including a forwarding roll positioned for the receipt of the tensioned yarn immediately prior to yarn packaging.

7. The apparatus of claim 6 wherein the crimping means is a stuffer box crimper.

* * * * *